US009254011B2

(12) United States Patent
Gallup

(10) Patent No.: US 9,254,011 B2
(45) Date of Patent: Feb. 9, 2016

(54) LIGHTED BELT KEEPER

(71) Applicant: Matthew David Gallup, Wayne, NJ (US)

(72) Inventor: Matthew David Gallup, Wayne, NJ (US)

(73) Assignee: Rescue Leaders, LLC, Paterson, NJ (US)

( * ) Notice: Subject to any disclaimer, the term of this patent is extended or adjusted under 35 U.S.C. 154(b) by 199 days.

(21) Appl. No.: 14/159,118

(22) Filed: Jan. 20, 2014

(65) Prior Publication Data

US 2015/0092401 A1 Apr. 2, 2015

Related U.S. Application Data

(60) Provisional application No. 61/885,655, filed on Oct. 2, 2013.

(51) Int. Cl.

| | |
|---|---|
| ***F21L 14/00*** | (2006.01) |
| ***A41D 13/01*** | (2006.01) |
| ***F21V 33/00*** | (2006.01) |
| ***A45F 5/02*** | (2006.01) |
| ***F21L 4/00*** | (2006.01) |

(52) U.S. Cl.

CPC ..... *A41D 13/01* (2013.01); *A45F 5/021* (2013.01); *F21L 4/00* (2013.01); *F21V 33/0008* (2013.01); *F21V 33/0076* (2013.01)

(58) Field of Classification Search

CPC ..... A41D 13/01; F21L 4/00; F21V 33/008; A45F 5/021

USPC ..... 362/103, 108

See application file for complete search history.

(56) References Cited

U.S. PATENT DOCUMENTS

| | | | | | |
|---|---|---|---|---|---|
| 5,630,382 | A * | 5/1997 | Barbera | A01K 27/006 | 362/108 |
| 6,095,657 | A * | 8/2000 | Kent | F21L 11/00 | 362/108 |
| 6,106,130 | A * | 8/2000 | Harding | A41D 13/01 | 362/103 |
| 2013/0128556 | A1* | 5/2013 | Brauser | A01K 27/006 | 362/108 |

* cited by examiner

*Primary Examiner* — David V Bruce
(74) *Attorney, Agent, or Firm* — John H. Choi

(57) ABSTRACT

A lighted belt keeper may include a housing comprising a power source compartment that opens to a first end, wherein a power source may be enclosed by a power source compartment closure. A cover may enclose the power source and power source compartment closure. The cover may removably attach to the first end of the housing. A light may attach to a second end of the housing. The housing and cover may attach to a base which may attach to a first end of a strap by a fastener. A second and a third fastener may be attached to the strap to removably hold the strap in position while the strap may surround an object such as a utility belt, pant belt or the like. In certain embodiments, instead of a strap, the base may have wings that removably attach to each other.

11 Claims, 5 Drawing Sheets

FIG. 6
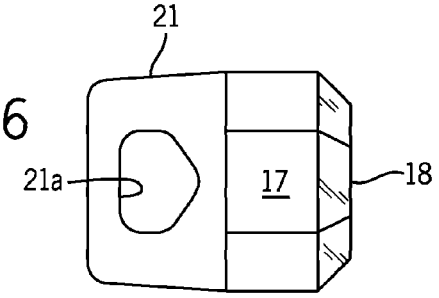
FIG. 7
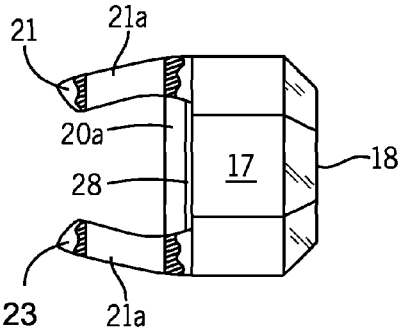
FIG. 8
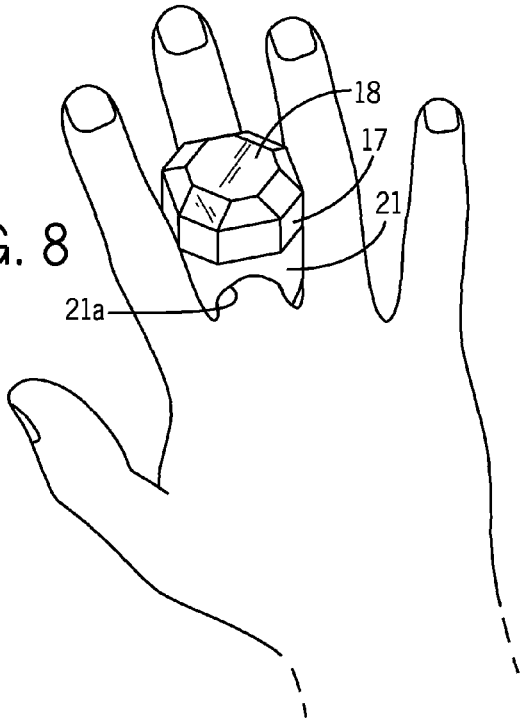
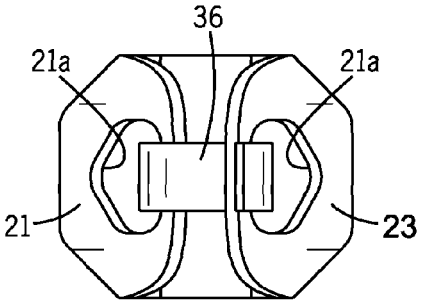
FIG. 9

LIGHTED BELT KEEPER

CROSS-REFERENCE TO RELATED APPLICATION

This application claims the benefit of U.S. provisional application No. 61/885,655, filed Oct. 2, 2013, the contents of which are herein incorporated by reference.

BACKGROUND OF THE INVENTION

The present invention relates to belt keepers and, more particularly, to a lighted flashing belt keeper.

Currently, belt keepers are used in emergency services by individuals to keep their utility belts attached to their pant belt. There are no lights to warn of hazards during these emergency services and the like.

As can be seen, there is a need for a lighted belt keeper that may have the ability to provide a flashing light.

SUMMARY OF THE INVENTION

In one aspect of the present invention, a lighted belt keeper comprises: a base having a first wing and a second wing; a housing comprising a power source compartment open to a first end, wherein a power source is enclosed by a power source compartment closure; a cover enclosing the power source and power source compartment closure, wherein the cover removably attaches to the first end of the housing; and a light attached to a second end of the housing.

In another aspect of the present invention, a lighted belt keeper comprises: a strap comprising a first end and a second end; a first fastener comprising a first fastener primary member and a first fastener secondary member, wherein the first fastener primary member attaches to the first end of the strap; a base surrounding the first fastener secondary member; a plate, wherein the first fastener secondary member of the first fastener attaches to the plate, wherein the first fastener secondary member removably attaches to the first fastener primary member; a housing comprising a power source compartment open to a first end, wherein a power source is enclosed by a power source compartment closure; a cover enclosing the power source and power source compartment closure, wherein the cover removably attaches to the first end of the housing, wherein the cover attaches to the plate; and a light attached to a second end of the housing.

In another aspect of the present invention, a lighted belt keeper comprises: a strap comprising a first end and a second end; a first fastener comprising a first fastener primary member and a first fastener secondary member, wherein the first fastener primary member attaches to the first end of the strap and the first fastener secondary member removably attaches to the first fastener primary member; a base attached to the first fastener secondary member; a housing comprising a power source compartment open to a first end, wherein a power source is enclosed by a power source compartment closure; a cover enclosing the power source and power source compartment closure, wherein the cover removably attaches to the first end of the housing, wherein the cover attaches to the base; and a light attached to a second end of the housing.

These and other features, aspects and advantages of the present invention will become better understood with reference to the following drawings, description and claims.

BRIEF DESCRIPTION OF THE DRAWINGS

FIG. 6 is a side elevation view of the light unit of an exemplary embodiment of the present invention;

FIG. 7 is a top view of an exemplary embodiment of the present invention with parts broken away;

FIG. 8 is a perspective view of an exemplary embodiment of the present invention showing another use of the present invention;

FIG. 9 is a bottom view of a second embodiment of the present invention;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a lighted belt keeper that may include a housing comprising a power source compartment that opens to a first end, wherein a power source may be enclosed by a power source compartment closure. A cover may enclose the power source and power source compartment closure. The cover may removably attach to the first end of the housing. A light may attach to a second end of the housing. The housing and cover may attach to a base which may attach to a first end of a strap by a fastener. A second and a third fastener may be attached to the strap to removably hold the strap in position while the strap may surround an object such as a utility belt, pant belt or the like. In certain embodiments, instead of a strap, the base may have wings that removably attach to each other.

Figure 1:
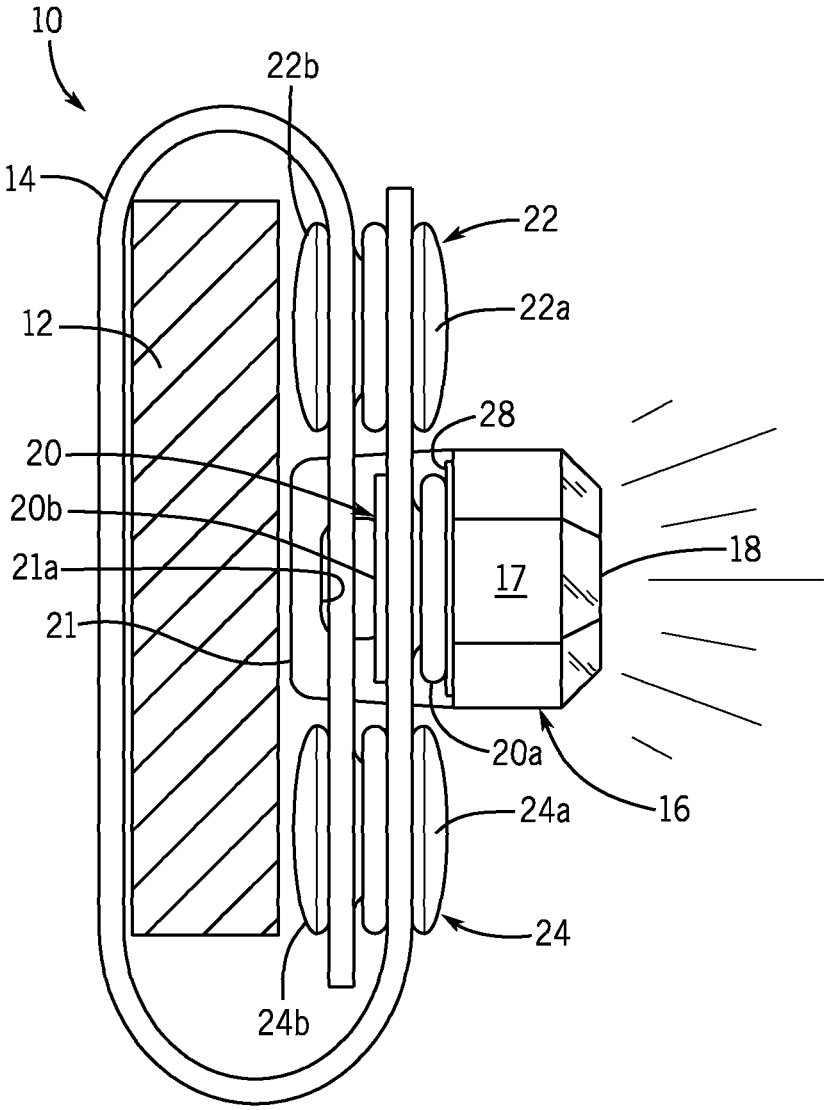
FIG. 1 is a side elevation view of an exemplary embodiment of the present invention in use.
Figure 2:
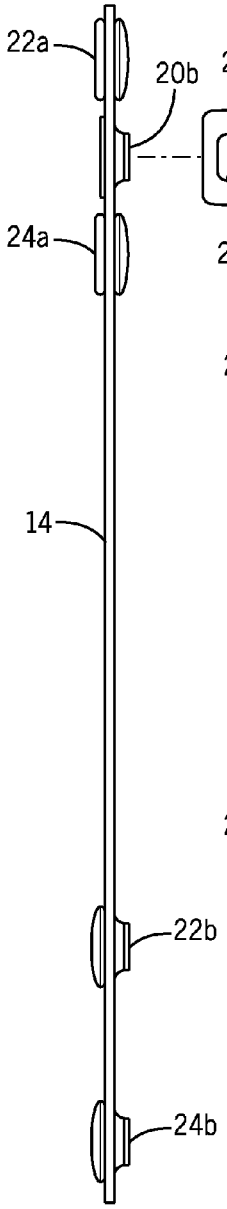
FIG. 2 is a side elevation view of an exemplary embodiment of the present invention with a light unit exploded.
Figure 3:
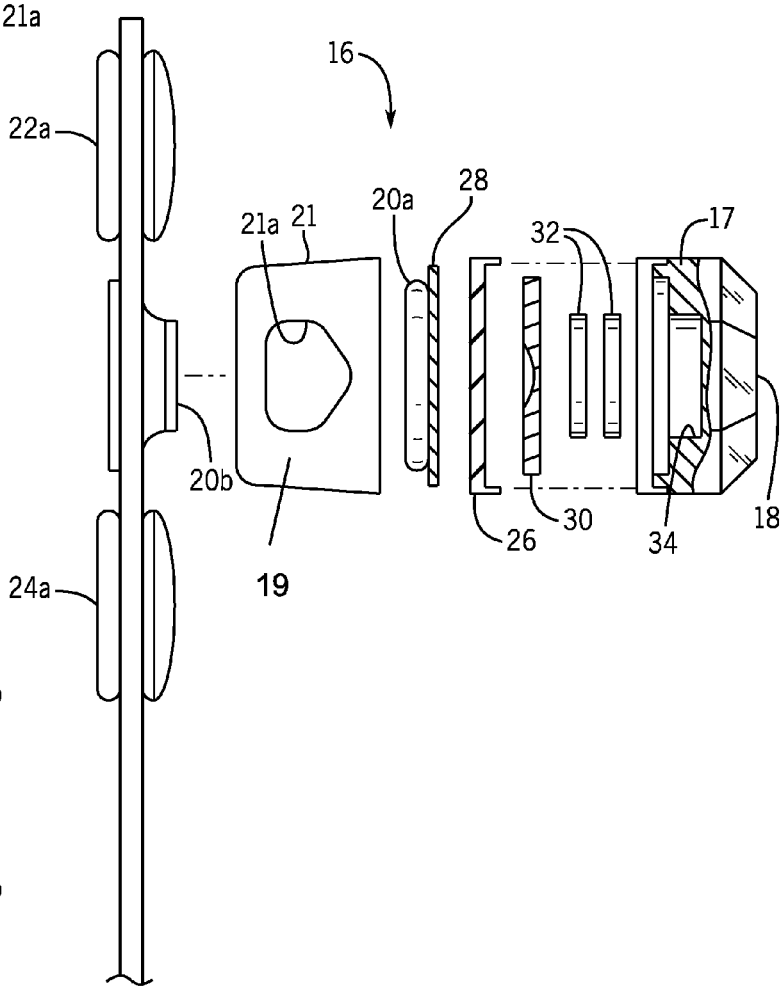
FIG. 3 is a detail exploded side elevation view of an exemplary embodiment of the present invention.
Figure 4:
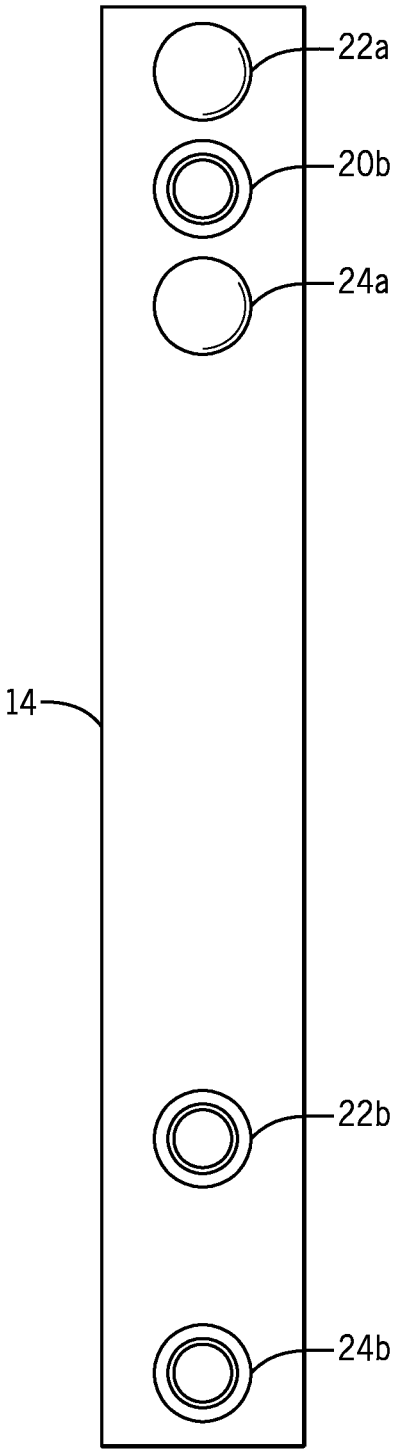
FIG. 4 is a front elevation view of an exemplary embodiment of the present invention.
Figure 5:
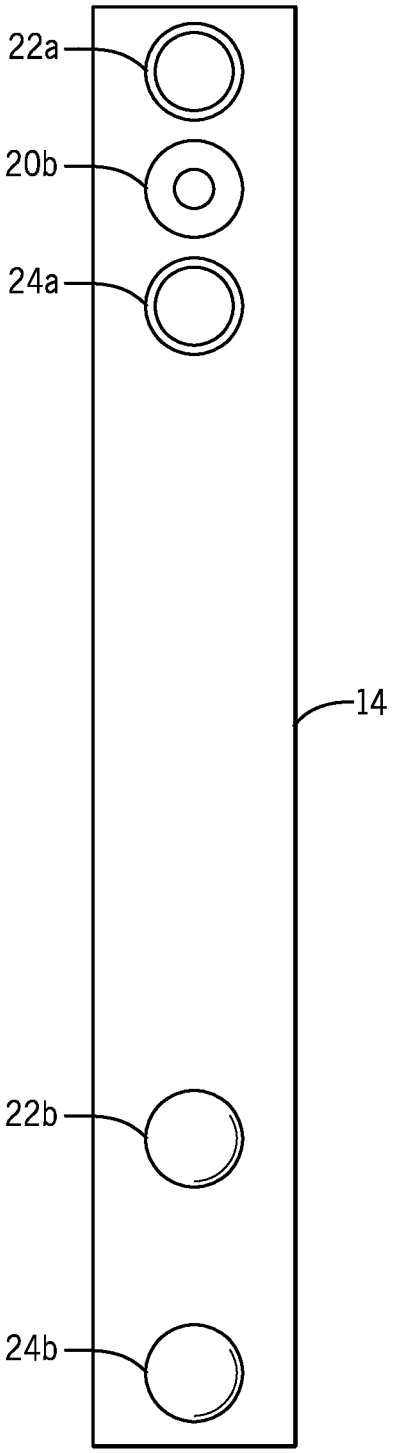
FIG. 5 is a rear elevation view of an exemplary embodiment of the present invention.
Figure 10:
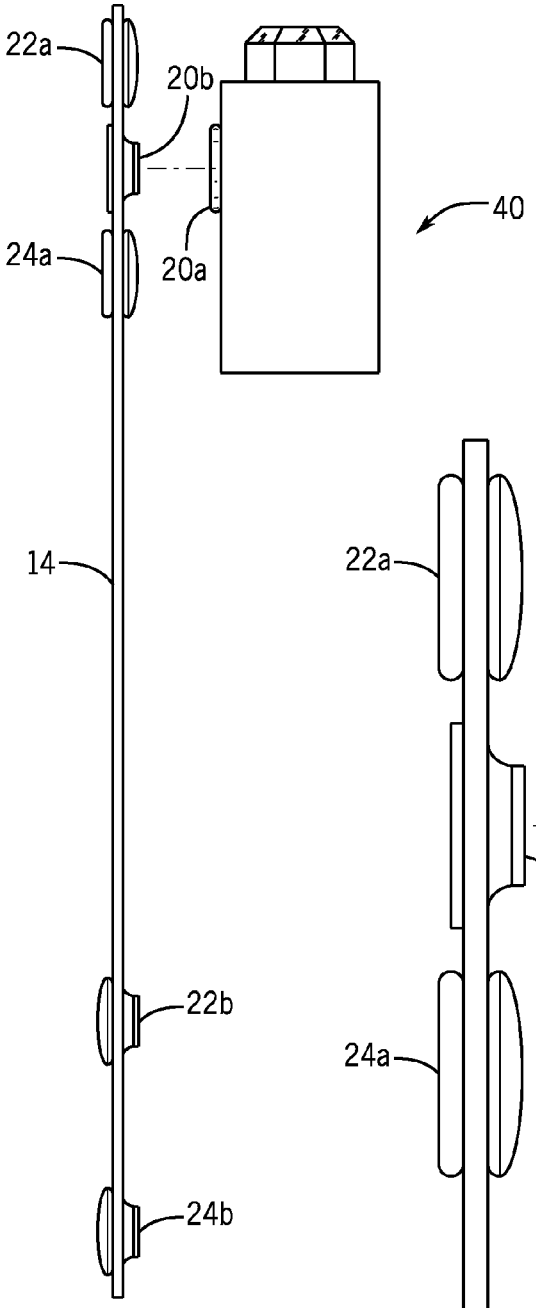
FIG. 10 is a side elevation view of a third embodiment of the present invention with the light unit exploded.
Figure 11:
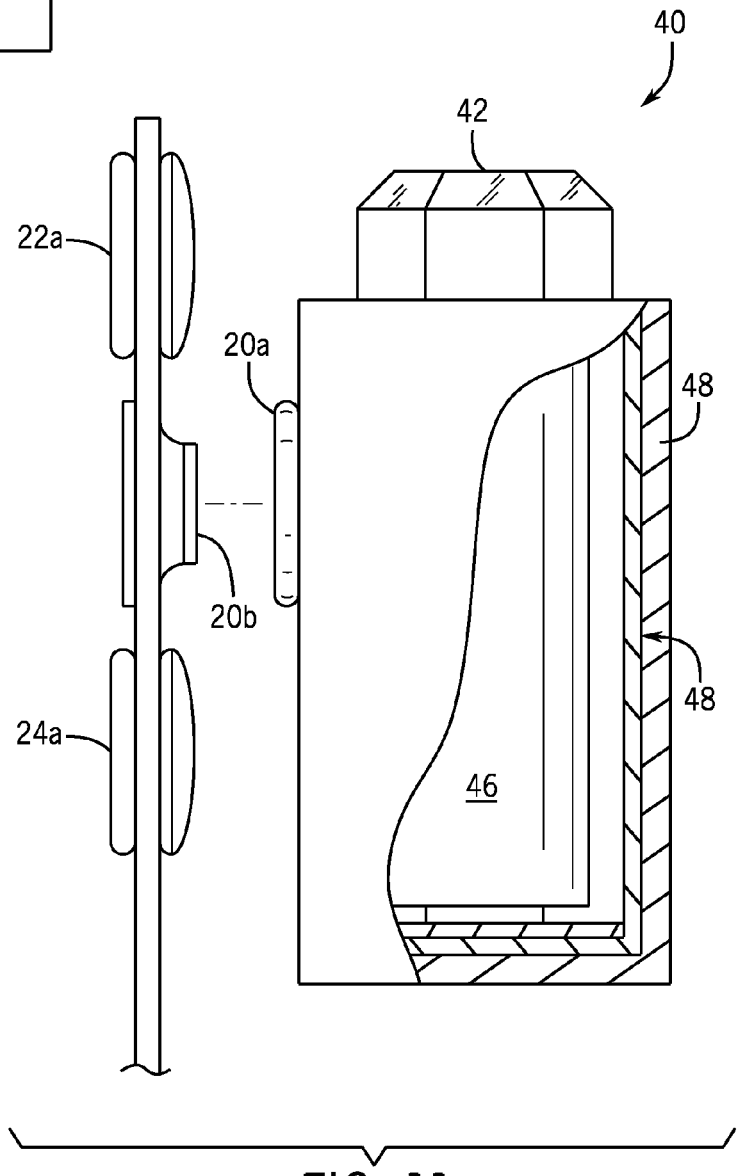
FIG. 11 is a detail exploded elevation view of the third embodiment of the present invention with parts broken away.

As is illustrated in FIGS. 1 through 11, the lighted belt keeper 10 may include a light unit 16. The light unit 16 may include a housing 17 having a power source compartment 34 open to a first end. The housing 17 may be water resistant. A power source may fit inside the power source compartment 34 of the housing 17. The power source may include at least one battery 32. The at least one battery 32 may be a lithium battery. A power source compartment closure 30 may enclose the power source within the power source compartment 34 of the housing 17. The light unit 16 may also include a cover 26 which may enclose the power source and the power source compartment closure 30 within the housing 17. The cover 26 may removably attach to the first end of the housing 17. A light 18 may attach to a second end of the housing 17 and be connected to the power source. The light 18 may be a light-emitting diode (LED), an infra-red beacon or the like. In certain embodiments, the light 18 may include two diodes with a push to activate mechanism that may allow continuous light or a flashing light. In certain embodiments, the light used may be a different color based on what may be required for the use of the present invention. In certain embodiments, the cover 26 may attach to a plate 28. The plate 28 may attach to a first fastener secondary member 20*a* of a first fastener 20.

The plate 28 and the first fastener secondary member 20*a* may be surrounded by the base 19. The base 19 may have an opening where there may be a first wing 21 and a second wing 23. The first wing 21 and the second wing 23 may have finger holes 21*a*.

The first fastener secondary member 20*a* may removably attach to a first fastener primary member 20*b* of the first fastener 20. The first fastener primary member 20*b* may be attached to a strap 14. In certain embodiments, the strap 14 may also have a second fastener 22 and a third fastener 24. The second fastener 22 may have a second fastener secondary member 22*a* and a second fastener primary member 22*b*. The third fastener 24 may have a third fastener secondary member 24*a* and a third fastener primary member 24*b*. The strap 14 may be removably attached to a belt 12 such as a utility belt, a pants belt and the like. The strap 14 may also be attached to another object where the strap may be wrapped around the object in question. In certain embodiments, the second fastener 22 and the third fastener 24 may be used in order to further secure the strap 14 to the object.

In certain embodiments, the first wing 21 and the second wing 23 may wrap around an object and be removably secured by a hook 36. In certain embodiments, the hook 36 may have an S-shape. The light unit 16 may be used potentially on the hand of a user as another way to hold the light unit 16.

In a third embodiment 40, a light unit 42 may attach to a pouch 48. In certain embodiments, the light unit 42 may be a clear lens. The pouch 48 may have a battery 46 enclosed inside of the pouch 48. The pouch 48 may attach to the first fastener secondary member 20*a*. The first fastener secondary member 20*a* may removably attach to the first fastener primary member 20*b*. In certain embodiments, the fasteners may have a snap socket and stud, a hook and latch system or the like.

A method of using the lighted belt keeper may include the user illuminating themselves to avoid hazards. Examples of individuals that may use the present invention may include police officers conducting motor vehicle stops, children wearing the present device in busy malls, riding their bicycles; crossing guards may bring more attention to themselves to avoid getting hit by traffic. Utility workers may wear the present invention to be seen to avoid getting injured on a work site. Parents may place the present invention on strollers to illuminate them to avoid getting hit by traffic. Firefighters may place them on the rear of the air packs so they can be seen in a smoky fire. Rescue workers may be safer helping others at accident scenes so drivers may see them and their equipment because the light flashes and brings attention to their presence. People may place these lights on pets and their own belts 12 so traffic and other individuals may see them easily. Nursing homes may place the lighted belt keeper of elderly patients to keep better track of their location. Hikers may wear the present invention to be located when they are lost or to mark a trail. Garbage men may wear the present invention to avoid being struck in traffic and construction and paving workers may mark themselves to avoid hazards like traffic, heavy equipment use, and they may also be used to mark dangerous sites. The lighted belt keeper may be snapped onto objects to display them and bring additional attention to them. People may wear the present invention at clubs and they may wear the present invention if they break down on the side of the road. Tree crews may attach the present invention to trees that need to be taken down. The lighted belt keeper may attach to anything someone wants to draw attention to in their lives. An example may be to include the infra-red beacon alerting others to the user's location in low light or complete darkness. In certain embodiments, this may include emitting a light only detected by infra-red vision so that specialized weapons and tactical teams may be alerted of the location while remaining undetected by an adversary. Another situation may be a firefighter alerting his location in complete darkness which may include a smoke filled environment.

It should be understood, of course, that the foregoing relates to exemplary embodiments of the invention and that modifications may be made without departing from the spirit and scope of the invention as set forth in the following claims.

What is claimed is:

1. A lighted belt keeper comprising:

a base having a first wing and a second wing;

a housing comprising a power source compartment open to a first end, wherein a power source is enclosed by a power source compartment closure;

a cover enclosing the power source and power source compartment closure, wherein the cover removably attaches to the first end of the housing; and a light attached to a second end of the housing, wherein the light connects to the power source.

2. The lighted belt keeper of claim 1, further comprising a hook removably connecting the first wing and the second wing of the base.

3. The lighted belt keeper of claim 2, wherein the hook is S-shaped.

4. The lighted belt keeper of claim 1, wherein the power source is at least one battery.

5. A lighted belt keeper comprising:

a strap comprising a first end and a second end;

a first fastener comprising a first fastener primary member and a first fastener secondary member, wherein the first fastener primary member attaches to the first end of the strap;

a base surrounding the first fastener secondary member;

a plate, wherein the first fastener secondary member of the first fastener attaches to the plate, wherein the first fastener secondary member removably attaches to the first fastener primary member;

a housing comprising a power source compartment open to a first end, wherein a power source is enclosed by a power source compartment closure;

a cover enclosing the power source and power source compartment closure, wherein the cover removably attaches to the first end of the housing, wherein the cover attaches to the plate; and a light attached to a second end of the housing, wherein the light connects to the power source.

6. The lighted belt keeper of claim 5, wherein the power source is at least one battery.

7. The lighted belt keeper of claim 5, further comprising a second fastener having a second fastener primary member and a second fastener secondary member, wherein the second fastener primary member attaches to one of the first end and second end of the strap and the second fastener secondary member attaches to the other of the first end and second end of the strap to removably hold the strap in position while the strap surrounds an object.

8. The lighted belt keeper of claim 7, further comprising a third fastener having a third fastener primary member and a third fastener secondary member, wherein the third fastener primary member attaches to one of the first end and second end of the strap and the third fastener secondary member attaches to the other of the first end and second end of the strap to further removably hold the strap in position while the strap surrounds an object.

9. A lighted belt keeper comprising:

a strap comprising a first end and a second end;

a first fastener comprising a first fastener primary member and a first fastener secondary member, wherein the first fastener primary member attaches to the first end of the strap and the first fastener secondary member removably attaches to the first fastener primary member;

a base attached to the first fastener secondary member;

a housing comprising a power source compartment open to a first end, wherein a power source is enclosed by a power source compartment closure;

a cover enclosing the power source and power source compartment closure, wherein the cover removably attaches to the first end of the housing, wherein the cover attaches to the base; and a light attached to a second end of the housing, wherein the light connects to the power source.

10. The lighted belt keeper of claim 9, further comprising a second fastener having a second fastener primary member and a second fastener secondary member, wherein the second fastener primary member attaches to one of the first end and second send of the strap and the second fastener secondary member attaches to the other of the first end and second end of the strap to removably hold the strap in position while the strap surrounds an object.

11. The lighted belt keeper of claim 10, further comprising a third fastener having a third fastener primary member and a third fastener secondary member, wherein the third fastener primary member attaches to one of the first end and second end of the strap and the third fastener secondary member attaches to the other of the first end and second end of the strap to further removably hold the strap in position while the strap surrounds an object.

* * * * *